US006294485B1

(12) United States Patent
Hodson et al.

(10) Patent No.: US 6,294,485 B1
(45) **Date of Patent: *Sep. 25, 2001**

(54) PAPERMAKERS DRYER FABRIC

(75) Inventors: Mark Hodson; Timothy Ashworth; Paul Myerscough, all of Lancashire (GB)

(73) Assignee: Voith Fabrics Heidenheim GmbH & Co. KG, Heidenheim (DE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/051,720

(22) PCT Filed: Oct. 18, 1996

(86) PCT No.: PCT/GB96/02567

§ 371 Date: Jul. 16, 1998

§ 102(e) Date: Jul. 16, 1998

(87) PCT Pub. No.: WO97/14846

PCT Pub. Date: Apr. 24, 1997

(30) Foreign Application Priority Data

Oct. 18, 1995 (GB) ..... 9521299

(51) Int. Cl.[7] ..... B32B 27/08

(52) U.S. Cl. ..... 442/85; 442/66; 442/67; 442/175; 442/243; 442/252; 442/253; 162/902; 139/383 A; 139/470 A; 139/470 B

(58) Field of Search ..... 442/59, 66, 69, 442/85, 175, 243, 252, 253; 162/902; 139/420 A, 420 B, 383 A

(56) References Cited

U.S. PATENT DOCUMENTS

| | | | | |
|---|---|---|---|---|
| 4,172,910 | * | 10/1979 | Rotar | 427/243 |
| 4,423,543 | | 1/1984 | Leuvelink | 29/433 |
| 4,564,551 | | 1/1986 | Best | 428/222 |
| 4,588,632 | | 5/1986 | Gisbourne et al. | 428/212 |
| 4,731,281 | * | 3/1988 | Fleischer et al. | 428/196 |
| 4,820,571 | * | 4/1989 | Searfass | 442/189 |
| 5,118,557 | * | 6/1992 | Barnewall | 442/223 |
| 5,397,438 | | 3/1995 | Nyberg et al. | 162/207 |
| 5,846,604 | * | 12/1998 | Caldwell | 3/88 |
| 5,849,395 | * | 12/1998 | Valentine et al. | 428/195 |

FOREIGN PATENT DOCUMENTS 0 659 934 6/1995 (EP) .

* cited by examiner

*Primary Examiner*—Elizabeth M. Cole
*Assistant Examiner*—John J. Guarriello
(74) *Attorney, Agent, or Firm*—Caesar, Rivise, Bernstein, Cohen & Pokotilow, Ltd.

(57) ABSTRACT

A papermakers dryer fabric is operable to carry a paper web on one face thereof. The fabric comprises a base substrate that is coated and optionally partially or fully impregnated with resin so as to yield a substrate having a substantially impermeable and preferably smooth surface on the paper carrying side of the fabric.

11 Claims, 2 Drawing Sheets

PAPERMAKERS DRYER FABRIC

BACKGROUND OF THE INVENTION

FIELD OF THE INVENTION

The present invention relates to a papermakers dryer fabric.

Generally speaking papermaking machines are made up of three sections, namely the forming, pressing and drying sections. By the time the paper web enters the drying section from the pressing section as much as fifty percent of the water has been removed from the web. The remaining water removal then has to be completed in the dryer section. Here the paper web is carried by dryer fabrics transferring the web in succession from one to another of the rotating surfaces of batteries of steel cylinders arranged along the length of the machine and is heated by high pressure steam. It was previously considered essential for dryer fabrics to be appreciably permeable. Known dryer fabrics generally have a permeability of at least 250 cfm.

A key objective in the field of papermaking is to produce paper with uniform properties and characteristics. One of the main problems to be overcome in this respect is the fact that during the drying stage of the papermaking process the paper sheet shrinks more in the edge regions than in the center. This has an adverse effect on the physical properties of the paper as a whole, especially the dimensional stability. It is therefore desired for paper shrinkage to be as small and uniform as possible.

Techniques aimed at overcoming this problem are often termed "sheet restraint measures". One known proposal for overcoming this problem involves increasing the vacuum pressure in the dryer section suction rolls. However, this restraint is intermittent through the dryer section on successive suction rolls. Although this reduces shrinkage in the central region of the sheet, a large shrinkage difference remains between the edge sheet regions and the center of the sheet. Alternatively, it has been proposed to apply a negative pressure profile to a part of the path of the paper in the dryer section. This is unsatisfactory since sheet restraint is ideally required throughout each cycle within the dryer section.

U.S. Pat. No. 5,397,438 to Nyberg et al describes a method of ensuring sheet restraint throughout the dryer section without the need for costly vacuum or compressed air devices. This involves generating an adhesive force between the sheet and the dryer fabric. This is brought about by treating the edge regions of said fabric. In all cases the dryer fabric retains its permeability. One example of a suitable treatment method includes the incorporation of a statically chargeable material onto the fabric such that the positively charged fabric attracts the negatively charged cellulosic fibers of the sheet. Alternative treatment methods involve applying an adhesive material to the fabric or roughening or embossing the edge regions of the fabric. These treatments are somewhat complicated to achieve in a precise manner.

The present invention therefore seeks to provide an alternative papermakers fabric that provides sufficient sheet restraint properties.

According to the present invention there is provided a papermakers dryer fabric operable to carry a paper web on one face thereof. The fabric comprising a base substrate that is coated with and/or at least partially impregnated with resin so as to yield a substrate having a substantially impermeable surface on the paper carrying side of the fabric.

By "substantially impermeable" we mean a permeability of less than 50 cfm.

The base substrate is ideally partially or fully impregnated with resin.

Preferably, the paper carrying side of the fabric is essentially smooth. It has been found that the paper web adheres well to the substantially impermeable and essentially smooth surface of the fabric as the fabric passes through the dryer section.

Although superior adhesion of the paper web to the substantially impermeable coating is achieved by providing an essentially smooth surface on the paper-carrying side of the fabric, for some applications the surface of the belt may be provided with micro-profiles such as grooves, bumps, ridges, dot patterns or roughened regions, across all or part of the fabric width.

Since nearly 70% of all paper web shrinkage takes place in the last one third of the dryer section, the fabric according to the invention is ideally solely located in the latter dryer group runs in the section (i.e. the last third of the section) which preferably operate under closed draw conditions. These dryer fabrics may, however, be located throughout the dryer section.

The base substrate may be woven or nonwoven or a combination of woven and nonwoven materials. Suitable nonwoven materials include knitted fabrics, mesh structures, interlinked spiral fabrics, tessellated structures or combinations thereof. The base structure may have a single layer or multiple layers.

The resin may comprise any polymer which is stable to the combined forces of steam and high temperature (greater than 110° C.), which are typically found in a paper machine dryer section. Preferred resins include any of the following either alone or in combination: polyester, polyamide, polyamide-imides, polyimides, silicones, phenolic resins, PEEK, polyphenylene sulphide and epoxy resins including UV-curable polymers.

The resin may be cast as one or more layers from one or both faces of the belt. Ideally the resin is applied as a single monocoque cast from one side of the belt. The resin may be provided as a coating and/or impregnation treatment. The resin film may alternatively be applied by way of lamination. Alternatively, the resin may be provided in the form of melt deformable yarns incorporated into or onto the base substrate, that have been subjected to a combination of heat and pressure to yield an essentially smooth polymer surface. Ultra sonic bonding methods may even be used to iron out a smooth surface. Abrasion resistant material may be included in the resin, for example, aramid fiber pulp or (micro) particles of glass, ceramic or frit.

The surface on the paper-contacting side of the fabric is ideally smooth compared with conventional woven dryer fabrics, typically having an $R_2D$ surface roughness value less than 10.

The machine side of the fabric does not necessarily have to be resin-coated. If not then it is preferred for high wear resistant material yarns to predominate on the machine side and/or long machine direction floats to be present to reduce abrasion. The basecloth may be endless woven, seamed or joined by other methods such as ultrasonically welding or edge joining.

Reinforcement yarns may also be incorporated into the fabric belt. These reinforcement yarns are preferably aligned in the running direction of the belt. These further load-bearing yarns may lie on top of, underneath or in the middle (i.e. between the two membrane layers) of the membrane composite, or in any combination thereof. Such further yarns may be applied by means of a bobbin that travels across the belt in an axial direction. These yarns are preferably made from high molecular weight polyethylene, polyester, polyamide, high tenacity P.V.A. or Kevlar (RTM). The load bearing yarns increase the longitudinal strength vector in the running direction of the belt.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

In order that the present invention may be more readily understood specific embodiments thereof will now be described by way of example only with reference to the accompanying drawings in which:

DESCRIPTION OF THE INVENTION

Figure 1:
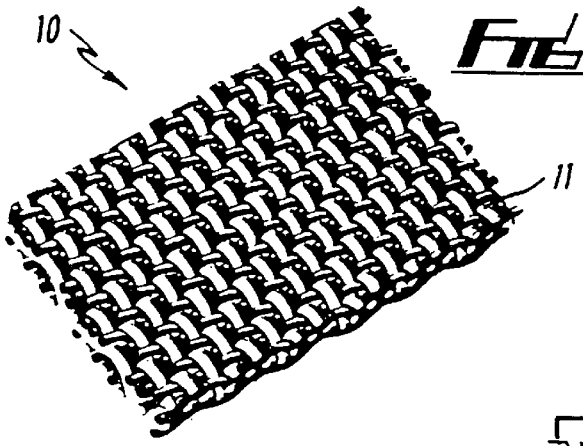
FIG. 1 is a perspective view of one base fabric of a papermakers dryer fabric in accordance with the invention.
Figure 2:
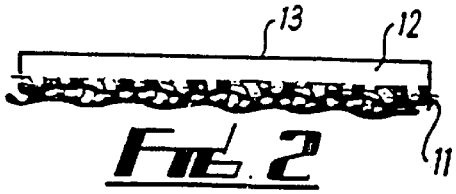
FIG. 2 is an end elevation of a papermakers dryer fabric in accordance with the invention comprising the base fabric of FIG. 1.

Referring to FIGS. 1 and 2 a papermakers dryer fabric 10 comprises a woven base cloth 11. The particular weave pattern illustrated is not essential to the operation of the invention. Any weave pattern may be used. A layer 12 of epoxy resin is coated on one side of the base cloth 11. Although the resin partially impregnates the base cloth 11, in the embodiment illustrated the coating does not extend to the remote side of the fabric. The thickness of the coating is ideally in the range from 0.1 to 1.0 mm. In use the resin coated side of the fabric will be the paper carrying side thereof and the remote side will be loaded on the paper machine. It is noted that the surface 13 of the coating, as illustrated, is essentially smooth.

Figure 3:
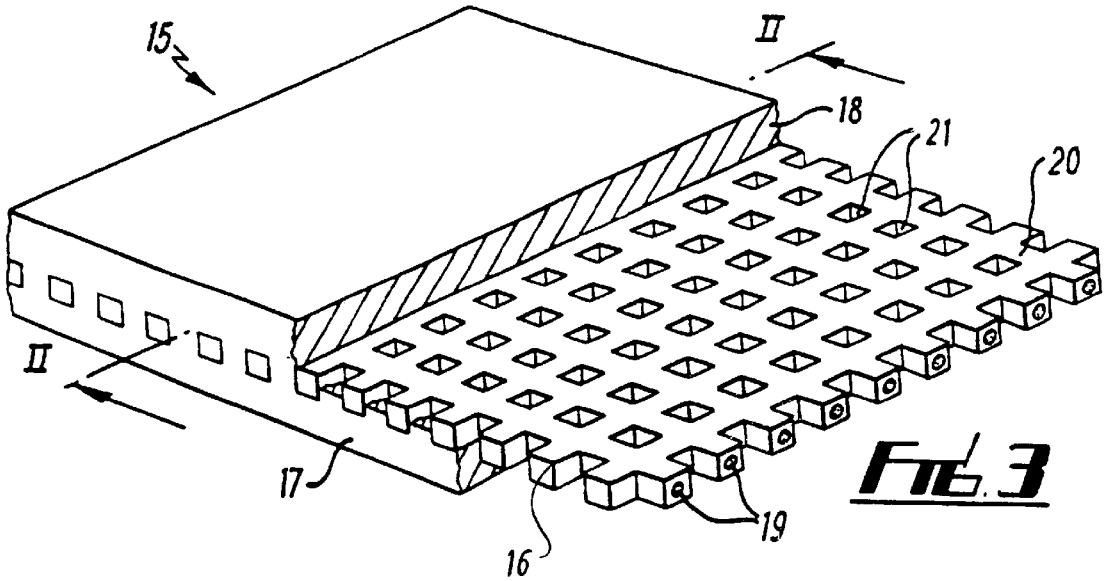
FIG. 3 is a perspective view, partly in section, of a second papermakers fabric in accordance with the invention.
Figure 4:
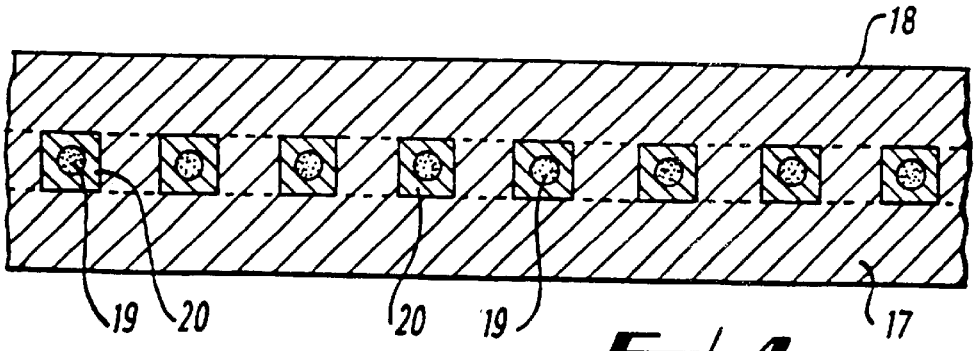
FIG. 4 is a cross sectional view of the fabric of FIG. 3 along the line II—II.

FIGS. 3 and 4 illustrate a further embodiment 15 of the invention. Here the base fabric consists of an apertured membrane 16 provided with facing layers 17,18 of an impermeable polymeric material.

Membrane 16 is produced in accordance with the method disclosed in United Kingdom Patent Specification No. 2202873 and includes reinforcing yarns 19, for example of polyester or polyamide monofilament or multifilament material extending in the running direction of the belt, the reinforcing yarns being positioned in the lands 20 existing between adjacent apertures 21. The apertures 21 are conveniently 1 mm square, the lands suitably being of the same width, and have a slight taper, the membrane being 1 mm thick.

It is noted that the membrane may be coated on only one side thereof. The coating material may comprise any suitable material and any coating method may be used so as to provide an essentially smooth impervious coating.

Figure 5:
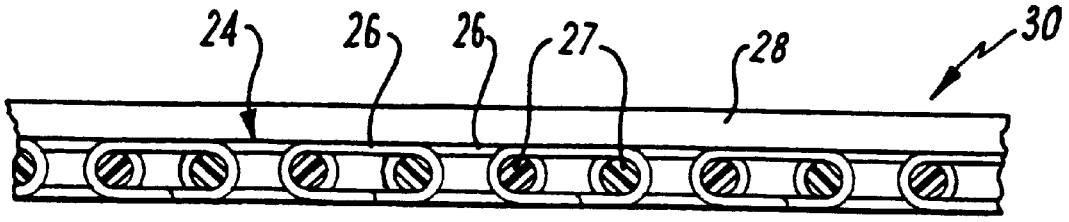
FIG. 5 is a side elevation of a further papermakers dryer fabric in accordance with the present invention.

Referring to FIG. 5 a base fabric 24 of a papermakers dryer fabric 30 is formed by interdigitation of a plurality of individual coils 26 and the introduction of a respective hinge wire 27 into the interdigitated turns of adjacent coils to connect the same together. The coils and hinge wires are made from polyester, such as polyethylene terephthalate or PEEK. The coils are preferably made from wires in the order of 0.5 mm in diameter. The construction of such a belt is described in U.S. Pat. No. 4,423,543 to Leuvelink.

The "link" base structure is coated on one side thereof with an impermeable resin matrix 28 so as to provide the belt illustrated in FIG. 5.

The dryer fabric of FIG. 5 may be made by locating the endless link base structure 30 in a tight disposition around two rollers. Endless continuous belts are provided on both sides of the link structure. The continuous belts run over rollers. Polymeric material is fed from one side of the link structure into a "cell" defined by the two belts. The polymer is fed through the link structure until it fills the space between the two continuous belts. The spacing between the belts is equal to the eventual thickness of the manufactured long nip press belt.

It is noted, for example, that the base cloth shown in the embodiment of FIG. 5 may be fully encapsulated in polymer. Furthermore a plurality of reinforcing yarns may be incorporated into the fabric, these yarns being aligned in the intended machine direction of the fabric belt.

It is to be understood that the embodiment described above is by way of illustration only. Many modifications and variations are possible.

Such variations are not to be regarded as a departure from the spirit and scope of the invention, and all such modifications as would be recognized by one skilled in the art are intended to be included within the scope of the following claims.

What is claimed is:

1. A dryer fabric for a paper machine, having a face for carrying a paper web thereon, said fabric comprising a base substrate, a coating formed by a layer of resin on said face to provide a substantially impermeable surface at said face, wherein said surface at said face is provided with microprofiles across at least part of the width of the fabric.

2. A dryer fabric according to claim 1, wherein said base substrate is partially impregnated with said resin.

3. A dryer fabric according to claim 1, wherein said base substrate is fully impregnated with said resin.

4. A dryer fabric according to claim 1, wherein said base substrate comprises a woven fabric.

5. A dryer fabric according to claim 1, wherein said base substrate comprises a nonwoven fabric.

6. A dryer fabric according to claim 1, wherein said base substrate comprises a combination of a woven and a nonwoven fabric.

7. A dryer fabric according to claim 1, wherein said resin comprises any of the following either alone or in combination: polyester, polyamide, polyamide; polyamide-imide copolymer; polyimide; a silicone; a phenolic resin; PEEK, polyphenylene sulphide, or an epoxy resin.

8. A dryer fabric according to claim 1, wherein said resin is applied as one or more layers onto at least said face of said fabric.

9. A dryer fabric according to claim 5, wherein said resin is applied as a single monocoque cast onto at least said face of said fabric.

10. A dryer fabric according to claim 1, wherein said resin is applied in the form of melt-deformable yarns incorporated into or onto said base substrate, which have been subjected to a combination of heat and pressure.

11. A dryer fabric for a paper machine, having a face for carrying a paper web thereon, said fabric comprising a base substrate, a coating formed by a layer of resin on said face to provide a substantially impermeable surface at said face, wherein said face of the fabric has an $R_2D$ surface roughness value of less than 10.

* * * * *